US005575627A

United States Patent [19]

Vairin et al.

[11] Patent Number: 5,575,627

[45] Date of Patent: Nov. 19, 1996

[54] HIGH AND LOW PRESSURE TWO STAGE PUMP AND PUMPING METHOD

[75] Inventors: Scott Vairin, Houston; Ken Vairin, Irving, both of Tex.

[73] Assignee: HyVair Corporation, Houston, Tex.

[21] Appl. No.: 371,878

[22] Filed: Jan. 12, 1995

[51] Int. Cl.[6] ..... F04B 3/00

[52] U.S. Cl. ..... 417/252; 417/259

[58] Field of Search ..... 417/251, 252, 417/259

[56] References Cited

U.S. PATENT DOCUMENTS

| | | | |
|---|---|---|---|
| 2,510,150 | 6/1950 | Stephens | 417/259 |
| 2,820,415 | 1/1958 | Born | 417/252 |
| 2,938,465 | 5/1960 | McFarland et al. | 417/252 |
| 3,016,838 | 1/1962 | Bessiere | 417/251 |
| 3,036,529 | 5/1962 | Archer | 417/252 |
| 3,544,239 | 12/1970 | Graham . | |
| 3,967,762 | 7/1976 | Machon . | |
| 4,062,639 | 12/1977 | Conlee . | |
| 4,215,548 | 8/1980 | Beremand . | |
| 4,551,075 | 11/1985 | Canalizo . | |
| 4,597,722 | 7/1986 | Tichy . | |
| 4,850,828 | 7/1989 | Yonezawa | 417/252 |
| 5,050,482 | 9/1991 | Yonezawa et al. . | |
| 5,051,074 | 9/1991 | Cowan . | |
| 5,069,602 | 12/1991 | Gipson . | |

FOREIGN PATENT DOCUMENTS

| | | | |
|---|---|---|---|
| 1363967 | 8/1974 | United Kingdom | 417/259 |

*Primary Examiner*—Timothy S. Thorpe
*Assistant Examiner*—William Wicker
*Attorney, Agent, or Firm*—Russell D. Culbertson; Shaffer & Culbertson

[57] ABSTRACT

A pump includes a high pressure portion and a low pressure portion. During low pressure, high volume operation, pressure produced in the high pressure portion of the pump is applied to drive a large area piston in the low pressure portion of the pump. Once the pressure in the high pressure portion of the pump raises to a cut-off pressure, at which time it takes excessive power to drive the large area piston, a cut-off valve opens to allow the high pressure portion of the pump to directly pump a relatively lower volume of fluid per stroke at a relatively higher pressure.

10 Claims, 3 Drawing Sheets

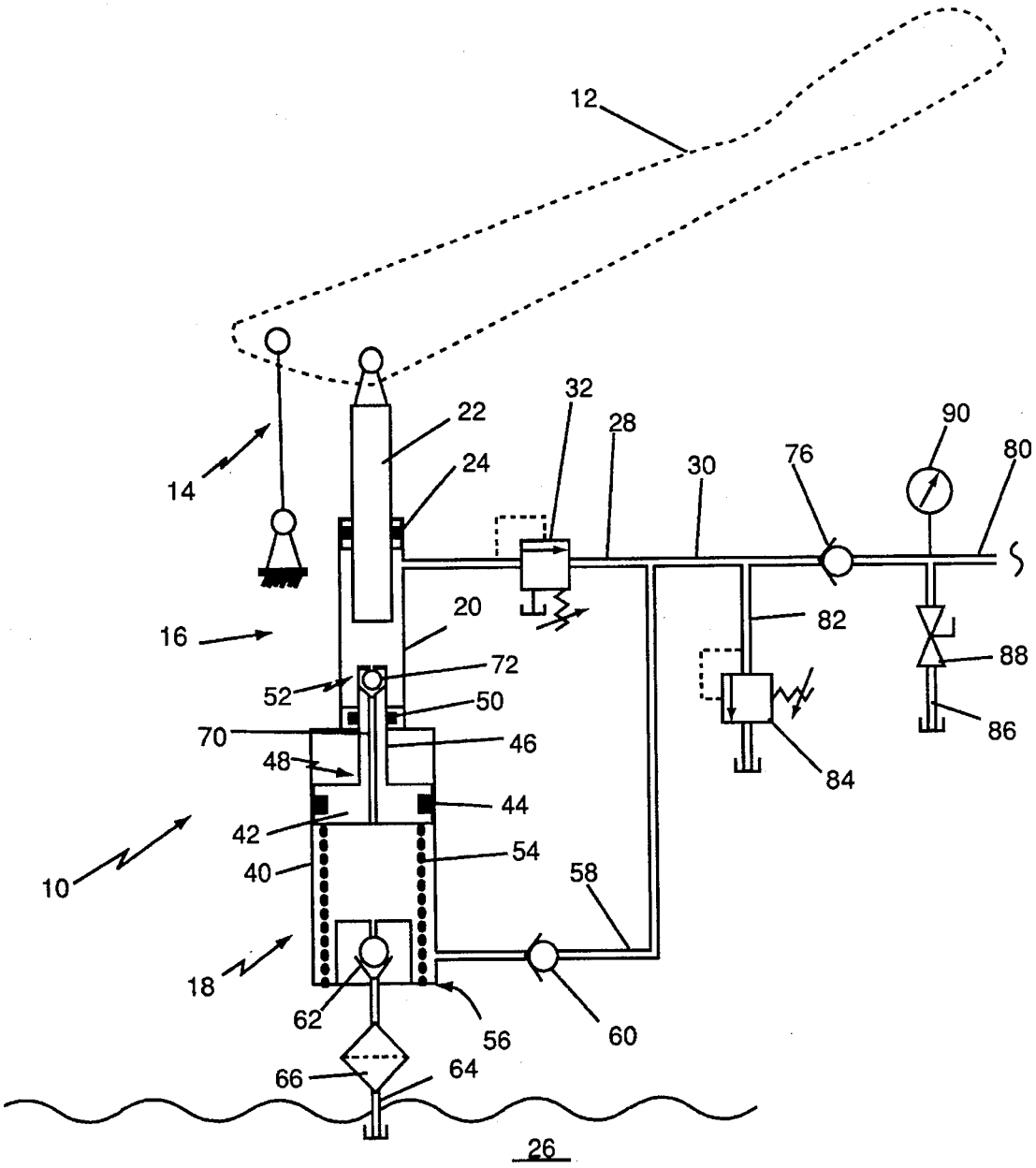
12
14
16
10
18
22
24
20
32
28
30
76
90
80
82
88
86
84
72
52
50
70
46
48
44
42
54
40
58
62
56
60
66
64
26

HIGH AND LOW PRESSURE TWO STAGE PUMP AND PUMPING METHOD

BACKGROUND OF THE INVENTION

This invention related to pumps, and particularly to a pump and pumping method for pumping both relatively high volumes at low pressure and also relatively lower volumes at higher pressures.

Many pump applications require a pump to move relatively large volumes of liquids, to fill a reservoir for example, and also apply a relatively high pressure to the fluid once the reservoir is filled. For example, oil well blowout preventer stacks must be tested periodically by plugging the wellhead to which the stack is connected, closing the blowout preventer mechanism to be tested, and then filling the area of the blowout preventer with a liquid and applying the desired test pressure. The pump used to fill the blowout preventer must be capable of moving a substantial volume of liquid to initially fill the blowout preventer stack and must also be capable of applying test pressure, which may be 5,000 psi or more.

However, pumps have heretofore been designed to operate in either a high volume, low pressure mode or a low volume, high pressure mode. The reason for this is that, mechanically, a given input power may be used to move a given volume of liquid at a certain pressure or a relatively lesser volume of liquid at a relatively higher pressure. Thus, in applications requiring a pump to move large volumes of liquid and also apply a high pressure, some compromise was required. The compromise often meant using a low volume, high pressure pump to move a large volume of liquid over an excessively long period of time. Even where a pump could switch from low pressure, high volume operation to high pressure, low volume operation, the pump had to be manually switched between modes, which was time consuming and required that the pump operator have some minimum level of training.

SUMMARY OF THE INVENTION

It is a general object of the invention to provide a pump that overcomes the above-described problems and others associated with pumping both large volumes and producing relatively high output pressure.

In order to accomplish this object, a pump according to the invention includes both a high pressure portion and a low pressure portion, each with a fluid outlet connected to a common pump output conduit. The high pressure pump portion uses pressure to initially drive a piston in the low pressure pump portion to move relatively high volumes of liquids at relatively low pressures. As the output pressure builds in the low pressure portion of the pump, the pressure in the high pressure portion also rises, eventually to a cut-off pressure at which a sequence valve associated with the high pressure portion opens. When the sequence valve opens, the high pressure portion of the pump no longer drives the low pressure piston, but rather continues pumping a relatively low volume of fluid a relatively high pressure above the cut-off pressure.

The pump and pumping method according to the invention allows a single pump structure to quickly move large volumes of liquid and also then supply a high pressure. The switch in operation from low pressure to high pressure operation requires no action by the operator. The apparatus and method switches automatically from low pressure to high pressure and back to low pressure operation without any intervention by the operator.

These and other objects, advantages, and features of the invention will be apparent from the following description of the preferred embodiments, considered along with the accompanying drawings.

BRIEF DESCRIPTION OF THE DRAWINGS

FIG. 3 is a mostly diagrammatic drawing showing the pump of FIG. 1 during high pressure operation.

DESCRIPTION OF THE PREFERRED EMBODIMENTS

Figure 1:
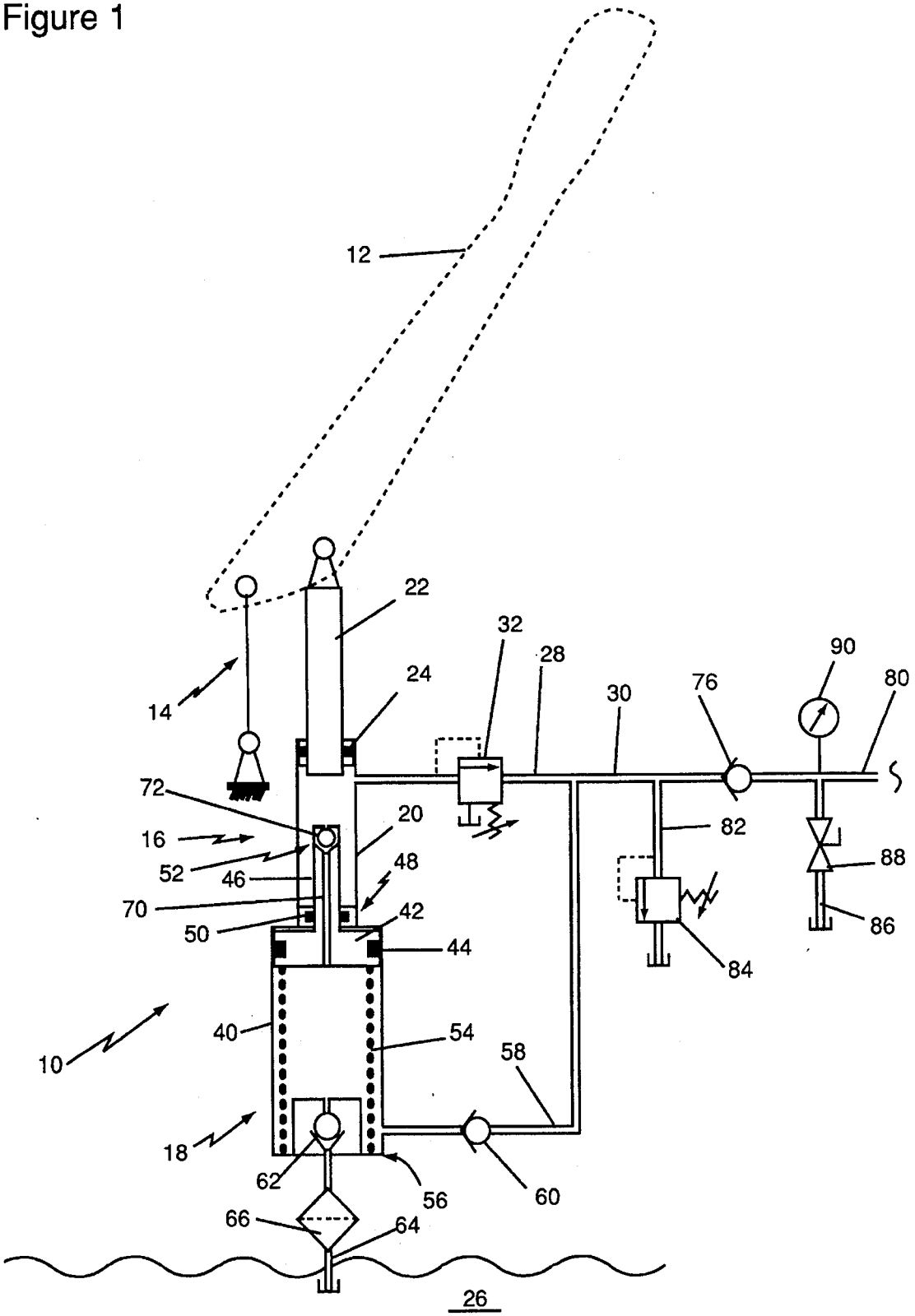
FIG. 1 is a mostly diagrammatic drawing showing a pump embodying the principles of the invention in a starting position.
Figure 2:
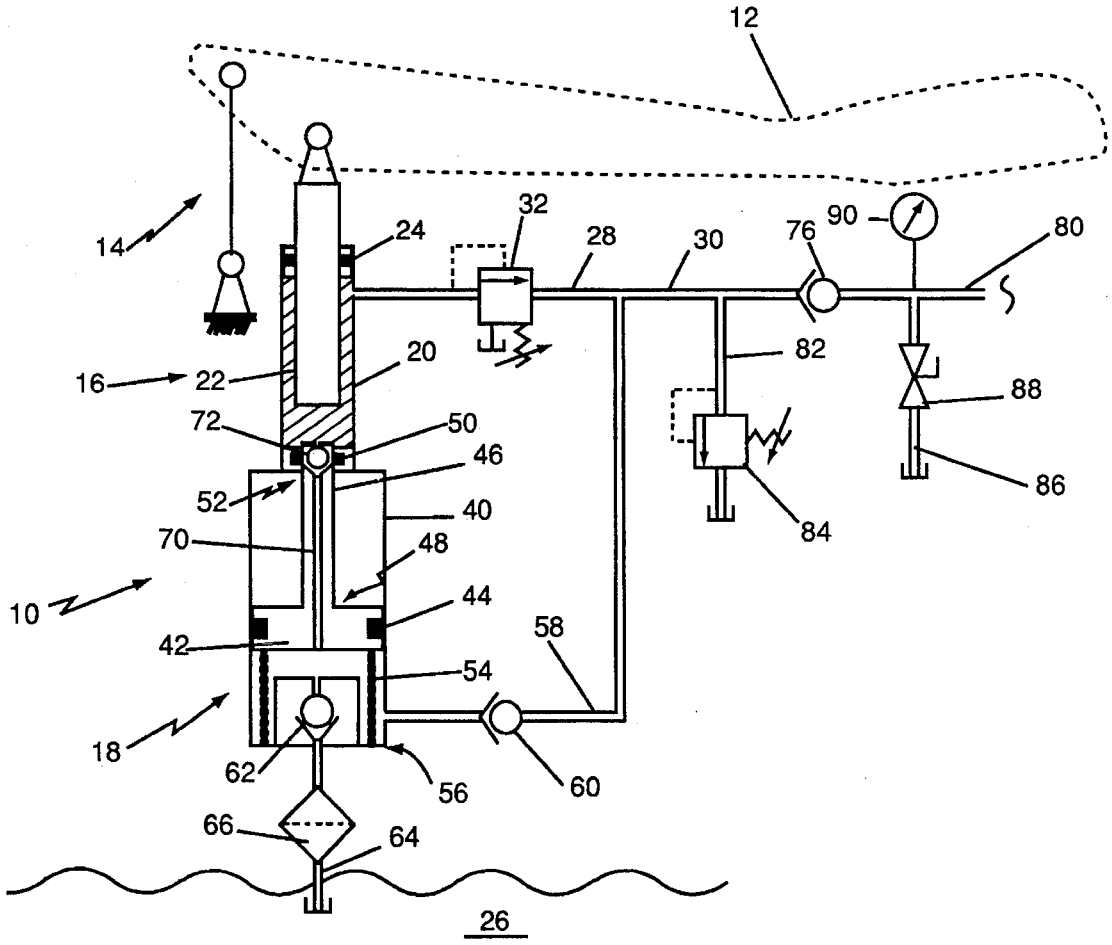
FIG. 2 is a mostly diagrammatic drawing of the pump shown in FIG. 1, but with the pistons moved to a second position.

A pump embodying the principles of the invention is shown generally at reference numeral 10 in FIGS. 1 through 3. Pump 10 is shown as a hand pump operated with a handle 12 connected through a standard three-bar linkage 14. The hand operated pump according to the invention is suitable for many applications. However, those skilled in the art will readily appreciate that any suitable means may be used to drive a pump embodying the principles of the invention. For example, the pump may be driven by a pneumatic actuator or other device.

The pump 10 includes a high pressure portion and a low pressure portion shown generally at reference numerals 16 and 18, respectively. The high pressure portion 16 includes a high pressure pump chamber or cylinder 20, a first or high pressure piston rod 22, and a first seal assembly 24. The high pressure pump chamber 20 is adapted to receive fluid to be pumped (shown at 26). The fluid to be pumped 26 will, for the remainder of this disclosure and the claims, be referred to simply as the fluid. The first piston rod 22 extends into the high pressure pump chamber 20 and is slideably received through the first seal assembly 24 so that it may be reciprocated within the high pressure pump chamber.

The high pressure pump chamber 20 may be cylindrical or any other suitable shape and may be made from any suitable material capable of withstanding the fluid pressure produced as the pump 10 operates. The piston rod 22 may similarly be comprised of any suitable material and may have any suitable transverse cross sectional shape. Although the high pressure piston rod 22 is shown diagrammatically in the drawings as being received loosely in the high pressure pump chamber 20, those skilled in the art will readily appreciate that the piston rod 22 may be stabilized by any suitable means to keep it properly aligned in the high pressure pump chamber during operation. Also, the first seal assembly 24 may be any suitable seal arrangement capable of slideably receiving the first piston rod 22 and allowing the first piston rod to reciprocate in the high pressure pump chamber 20 while maintaining a fluid-tight seal around the piston rod.

A high pressure fluid outlet conduit 28 extends between the high pressure pump chamber 20 and an output conduit 30. A cut-off pressure sequence valve 32 is connected in the high pressure fluid outlet conduit 28 to allow fluid to flow from the high pressure pump chamber 20 through the conduit only when a cut-off pressure is reached in the high pressure pump chamber. The valve 32 is preferably a sequence valve but may be any suitable valve or device for allowing fluid to flow in one direction only when a desired pressure differential is applied across the device.

The low pressure portion 18 of the pump 10 includes a low pressure pump chamber 40 with a low pressure piston 42 slideably received therein. The low pressure piston 42 includes a suitable seal arrangement 44 to seal against the inner wall of the low pressure pump chamber 40 so that the low pressure piston may displace fluid in the low pressure pump chamber as it moves downwardly, as shown in the drawings. The low pressure piston 42 is connected to a second piston rod 46 at a second end 48 of the rod with the rod extending upwardly in the drawings through an interchamber seal 50 so that a first end 52 of the rod exposed to fluid pressure in the high pressure pump chamber 20. The second piston rod 46 seals against the interchamber seal 50 to isolate pressure in the low pressure pump chamber 40 from the fluid pressure in the high pressure pump chamber 20. The second piston rod 46 acts as a pressure transfer means for transferring pressure of fluid in the high pressure pump chamber 20 to the low pressure piston 42 in the low pressure piston chamber 40. A spring 54 is included in the low pressure piston chamber 40 to bias the low pressure piston 42 upwardly in the drawings away from an inlet end 56 of the low pressure piston chamber toward an opposite end thereof. The end of the low pressure piston chamber 40 opposite the inlet end 56 includes openings, not shown, which are open to the atmosphere or to some other fluid.

A low pressure fluid outlet conduit 58 extends from the low pressure piston chamber 40 to the output conduit 30. A check valve 60 is connected in the low pressure fluid outlet conduit 58 in position to allow fluid to flow from the low pressure piston chamber 40 to the output conduit 30, but to prevent fluid from flowing back from the output conduit to the low pressure pump chamber. Also, the low pressure pump chamber 40 includes an inlet check valve 62 at its inlet end 56. The inlet check valve 62 allows fluid to flow or be drawn into the low pressure pump chamber 40, but closes to prevent fluid from flowing out therethrough. The inlet check valve 62 may be simply open to the reservoir of fluid to be pumped 26, or may be connected to an inlet conduit 64 extending into the fluid to be pumped. A suitable filter 66 may be used in the inlet conduit 64 to filter out solids that could damage the internal surfaces of the pump 10.

The pump 10 further includes a fluid transfer passage 70 for feeding fluid to be pumped 26 from the reservoir to the high pressure pump chamber 20. A check valve 72 in the fluid transfer passage 70 allows fluid to flow into the high pressure pump chamber 20, but prevents fluid from flowing in the opposite direction through the fluid transfer passage. In the preferred form of the invention, the fluid transfer passage 70 extends through the second piston rod 46 and low pressure piston 42 and is open at one end to the high pressure pump chamber 20 and at the opposite end to the low pressure pump chamber 40. This arrangement allows the high pressure pump chamber 20 to be filled with fluid that initially enters the low pressure pump chamber 40 through its inlet check valve 62 and inlet filter 66. Although this arrangement for the fluid transfer passage 70 is preferred, the fluid transfer passage may extend from the high pressure pump chamber 20 to the low pressure pump chamber 40 in some other location or may extend from the high pressure pump chamber directly into the reservoir of fluid to be pumped 26.

The illustrated form of the invention includes a check valve 76 connected in the output conduit 30 for preventing fluid from flowing back from the system 80 to the outlet conduits 28 and 58 and pump chambers 20 and 40. Also, a relief conduit 82 may be connected in the output conduit 30 with a separate pressure relief valve 84 adapted to open at an overload pressure. Since the pressure produced by the pump 10 is held on the system 80 with the output line check valve 76, a suitable pressure release or dump conduit 86 and valve 88 is preferably connected in the output conduit 30 to release pressure from the system. A gauge 90 can also be connected to the output conduit 30 to monitor the pressure in the system 80.

The operation of the pump 10 and method of pumping according to the invention can be described with reference to FIGS. 1 through 3. The pump 10 is shown in a starting position, or a first position, in FIG. 1, with the high pressure piston rod 22 withdrawn from the high pressure pump chamber 20 and the low pressure piston 42 at the opposite end of the low pressure pump chamber 42 from the inlet end 56. In this first position, the high pressure pump chamber 20 and low pressure pump chamber 40 both contain the maximum volume of fluid, the low pressure pump chamber having been filled through the inlet check valve 62 and the high pressure pump chamber having been filled through the fluid transfer passage 70 and check valve 72 as necessary. The check valves 60 and 76 prevent fluid from flowing back from the system 56 into the high pressure and low pressure pump chambers 20 and 40, respectively.

FIG. 2 shows the pump with the low pressure piston 42 and first piston rod 22 in a second position with the first piston rod at its maximum incursion depth into the high pressure pump chamber 20 and the low pressure piston as far as possible toward the inlet end 56 of the low pressure pump chamber. As the first piston rod 22 moves from the first position shown in FIG. 1 to the second position shown in FIG. 2, it displaces fluid, causing the second piston rod 46 and low pressure piston 42 to move downwardly. As the low pressure piston 42 moves downwardly, it displaces fluid from the low pressure pump chamber 40 through the low pressure outlet conduit 58 and check valve 60 while the inlet check valve 62 remains closed.

After the downward pump stroke of the high pressure piston rod 22, the high pressure piston rod is returned, in this case using the handle 12 to the first position shown in FIG. 1. The spring 54 in the low pressure pump chamber 40 helps the low pressure piston 42 to return to its first position shown in FIG. 1. The vacuum applied in the high pressure pump chamber 20, as the first piston rod 22 is withdrawn, also helps urge the low pressure piston 42 to its first position. As the low pressure piston 42 moves away from the inlet end of the low pressure pump chamber 40, the inlet check valve 62 opens to fill the low pressure pump chamber with fluid 26 while the low pressure outlet check valve 60 closes.

Referring now to FIG. 3, when the pressure builds up in the low pressure pump chamber 40 on the downward stroke, there is a corresponding rise in pressure in the high pressure pump chamber 20. When the pressure in the high pressure pump chamber 20 reaches a cut-off pressure, the high pressure outlet conduit sequence valve 32 opens, allowing low volumes of fluid to be pumped at a much higher pressure directly from the high pressure pump chamber. On the next upstroke to the first position shown in FIG. 1, the fluid transfer passage check valve 72 opens to fill the high pressure pump chamber 20 with the maximum volume of fluid. Then, on the next downstroke, after the high pressure pump chamber 20 is refilled, the low pressure piston 42 and second piston rod 46 stay in the first position as shown in FIG. 1, and only the first piston rod 22 moves downwardly, quickly producing the cut-off pressure in the high pressure pump chamber, causing the sequence valve 32 to open. High pressure pumping in this fashion may continue until reaching the desired pressure on the system.

A pump 10 according to the invention does not require any particular relationship between the areas of the first piston rod 22, second piston rod 46, and low pressure piston 42. However, certain relationships between these piston or rod areas may produce certain desirable pump characteristics. In one preferred form of the invention, the first piston rod 22 may have an area somewhat larger than the area of the second piston rod 46 exposed to the fluid pressure in the high pressure pump chamber 20. The low pressure piston 42 may have an area substantially larger than either the first piston rod 22 or second piston rod 46. With this relationship between the piston rods 22 and 46, and piston 42, a downward displacement of the first piston rod will produce a longer displacement of the second piston rod during low pressure operation. This longer displacement of the second piston rod 46 moves the low pressure piston 42 relatively further as compared to the displacement of the first piston rod 22, thereby displacing a relatively large volume of fluid from the low pressure piston chamber 40. Thus, the areas of the piston rods and low pressure piston can be chosen to provide desired operational characteristics for the pump.

The above described preferred embodiments are intended to illustrate the principles of the invention, but not to limit the scope of the invention. Various other embodiments and modifications to these preferred embodiments may be made by those skilled in the art without departing from the scope of the following claims. For example, the high pressure and low pressure pump chambers 20 and 40 may have numerous configurations to effect the pressure transfer from the high pressure pump chamber to the low pressure pump chamber.

I claim:

1. A pump comprising:

(a) a high pressure pump chamber connected to a low pressure pump chamber with an interchamber seal assembly positioned between the high pressure pump chamber and the low pressure pump chamber;

(b) a high pressure fluid outlet conduit extending from the high pressure pump chamber to an output conduit;

(c) a low pressure fluid outlet conduit extending from the low pressure pump chamber to the output conduit with a check valve therein preventing the flow of fluid from the low pressure fluid outlet conduit into the low pressure pump chamber;

(d) a first piston rod slideably received through a first seal assembly associated with the high pressure pump chamber;

(e) a low pressure piston slideably received in the low pressure pump chamber;

(f) a second piston rod slideably received through the interchamber seal assembly, the second piston rod for reciprocating through the interchamber seal assembly with a first end exposed to the fluid in the high pressure pump chamber and a second end extending into the low pressure pump chamber and connected to the low pressure piston;

(g) an inlet check vane at an inlet end of the low pressure pump chamber for enabling fluid to enter the low pressure pump chamber;

(h) an interchamber fluid passage extending through the second piston rod and low pressure piston, the interchamber fluid passage being open to the high pressure pump chamber and low pressure pump chamber and with a check valve therein for enabling fluid to flow only in the direction from the low pressure pump chamber to the high pressure pump chamber;

(i) biasing means for biasing the low pressure piston away from the inlet end of the low pressure pump chamber;

(j) sequence valve means connected in the high pressure fluid outlet conduit for allowing fluid to flow from the high pressure pump chamber when pressure in the high pressure pump chamber reaches a cutoff pressure; and (k) means for reciprocating the first piston rod through the first seal assembly.

2. The pump of claim 1 further comprising:

(a) a check valve connected in the output conduit for preventing fluid from flowing from the output conduit to the high pressure fluid outlet conduit.

3. The pump of claim 1 wherein:

(a) the first piston rod includes a fluid drive area larger than a fluid drive area of the second piston rod and less than a fluid drive area of the low pressure piston.

4. The pump of claim 1 wherein the biasing means comprises a spring mounted within the low pressure pump chamber.

5. The pump of claim 1 further including:

(a) a pressure relief conduit connected to the fluid output conduit and a pressure relief valve connected in the pressure relief conduit.

6. A pump comprising:

(a) a high pressure pump chamber;

(b) a low pressure pump chamber having an inlet end with inlet valve means for allowing fluid to enter the low pressure pump chamber at an inlet end thereof but for blocking flow out of the low pressure pump chamber inlet through the valve means;

(c) a high pressure fluid outlet conduit extending from the high pressure pump chamber to an output conduit;

(d) a low pressure fluid outlet conduit extending from the low pressure pump chamber to the output conduit;

(e) valve means associated with the high pressure outlet conduit and the low pressure outlet conduit for preventing fluid from flowing back into either the high pressure pump chamber or low pressure pump chamber through said outlet conduits;

(f) a low pressure piston slideably received in the low pressure pump chamber;

(g) high pressure piston means for displacing fluid in the high pressure pump chamber;

(h) pressure transfer means for applying the pressure of fluid in the high pressure pump chamber to the low pressure piston;

(i) biasing means for biasing the low pressure piston away from the inlet end of the low pressure pump chamber;

(j) fluid transfer means for enabling fluid to flow into the high pressure pump chamber while blocking fluid flow out of the high pressure pump chamber through said fluid transfer means; and (k) sequence valve means connected in the high pressure fluid outlet conduit for allowing fluid to flow from the high pressure pump chamber when the pressure of fluid in the high pressure pump chamber reaches a cutoff pressure.

7. The pump of claim 6 wherein the high pressure piston means comprises a piston rod slideably mounted in the high pressure pump chamber to allow the piston rod to reciprocate therein.

8. The pump of claim 6 wherein the pressure transfer means comprises a second piston rod positioned traversing an interchamber seal between the high pressure pump chamber and low pressure pump chamber, in position to reciprocate through the interchamber seal.

9. The pump of claim 6 wherein the fluid transfer means comprises a fluid transfer passage extending from the low pressure pump chamber to the high pressure pump chamber.

10. The pump of claim 9 wherein the fluid transfer passage extends through the second piston rod and low pressure piston.

* * * * *

UNITED STATES PATENT AND TRADEMARK OFFICE

CERTIFICATE OF CORRECTION

PATENT NO. : 5,575,627

DATED : November 19, 1996

INVENTOR(S) : Scott Varirin, et. al.

It is certified that error appears in the above-indentified patent and that said Letters Patent is hereby corrected as shown below:

Column 5, line 63, change "cane" to--valve--.

Signed and Sealed this

Eleventh Day of February, 1997

Bruce Lehman

*Attest:*

BRUCE LEHMAN

*Attesting Officer*

*Commissioner of Patents and Trademarks*